US007686254B2

(12) United States Patent
Mutzenberg

(10) Patent No.: US 7,686,254 B2
(45) Date of Patent: Mar. 30, 2010

(54) FORCE BALANCING KITE CONTROL SYSTEM

(76) Inventor: Frank Walter Mutzenberg, 796 E. Kuiaha Rd., Haiku, HI (US) 96708

( * ) Notice: Subject to any disclaimer, the term of this patent is extended or adjusted under 35 U.S.C. 154(b) by 202 days.

(21) Appl. No.: 11/686,360

(22) Filed: Mar. 15, 2007

(65) Prior Publication Data

US 2008/0223989 A1 Sep. 18, 2008

(51) Int. Cl.
*A63H 27/00* (2006.01)

(52) U.S. Cl. ..... 244/155 A; 244/153 R; 244/155 R

(58) Field of Classification Search ..... 244/155 A, 244/153 R, 155 R
See application file for complete search history.

(56) References Cited

U.S. PATENT DOCUMENTS 5,026,007 A * 6/1991 Gellert ..... 244/155 A
6,513,759 B2 * 2/2003 Starbuck ..... 244/155 A
6,514,115 B2 * 2/2003 Harich ..... 446/34
6,581,879 B2 * 6/2003 Bellacera ..... 244/155 A
6,745,713 B2 * 6/2004 Starbuck ..... 114/39.16
7,182,294 B2 * 2/2007 Blackman ..... 244/155 A
2002/0084384 A1 * 7/2002 Bellacera ..... 244/155 A
2005/0121556 A1 * 6/2005 Blackman ..... 244/155 A
2006/0226294 A1 * 10/2006 Logosz et al. ..... 244/152

FOREIGN PATENT DOCUMENTS

FR 2762583 4/1997
FR 2873093 7/2004

* cited by examiner

*Primary Examiner*—Michael R Mansen
*Assistant Examiner*—Philip J Bonzell

(57) ABSTRACT

An improvement to kite control systems for power kites, comprising at least one proportional redirection mechanism, which balances the forces of the main lifting force of the kite and the control handlebar, thus assisting with steering the kite and significantly reducing the effort needed to hold or pull the control handlebar, without taking away the flexibility to instantly depower the kite. A compound pulley system can be used as a proportional redirection device as described in one embodiment, or levers can used as shown in an alternative embodiment.

3 Claims, 5 Drawing Sheets

FORCE BALANCING KITE CONTROL SYSTEM

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to control systems for kites, especially for, but not limited to traction kites used in the sport of kite surfing, snow kiting and other sports involving a person operating a kite as a means for propulsion.

2. Prior Art

Kite control systems for use with multi-line traction kites commonly consist of (a) a center rope (8) which operatively connects a kite operator's harness (15) to the supporting flying lines (3) and (4) of a kite (1), which are connected to the leading edge (2) of the kite, and (b) a movable control handlebar (11) which slides along the center rope, guided by a hole in the center of the bar. The left end of the bar is linked to a left control line (5), and the right end to a right control line (6). The control lines are attached either directly to the bar, or in an improved design linked indirectly through a pulley.

The handlebar is held by a human kite operator (14) with both hands and is used for a dual purpose: (a) to steer the kite to either side and (b) to adjust the angle of the kite relative to the wind in order to increase or decrease the lifting power generated by the kite, commonly referred to as powering or depowering the kite, or in sailing terms: "sheeting in" or "sheeting out" respectively.

To steer the kite, the control handlebar has to be pulled with one hand while releasing the other hand. To power or depower the kite, the handlebar needs to be either pulled or released with both hands simultaneously.

These actions require a significant amount of effort by the kite operator because part of the lifting power of the kite is distributed to the control lines. It is a common complaint among kite boarders that their arms and hands get prematurely tired when practicing their sport.

The french patent FR2762583 'Systeme de controle d'une aile ellipsoidal generalment en forme de fuseau spherique et retenue par des lignes' describes a prior art system as illustrated above.

Another french patent FR2873093 'Dispositif de controle pour ailes de traction' describes a 2:1 advantage steering system where each control line goes around a pulley (12*a*) and (12*b*) attached to each end of the handlebar. This recent development dramatically improves the maneuverability of the kite on the one hand, but on the other hand even increases the problems described above, due to an increased force on the handlebar. Some manufacturers therefore have abandoned the 2:1 steering system already.

Several attempts have been made to reduce the amount of effort necessary to control the kite. One such attempt is an extra harness loop (13) attached to the handlebar, which simply can be hooked to the harness and by doing so fixing the handlebar in place. The problem with this attempt is that it takes too long to unhook in case of a sudden need to depower, for instance because of a wind gust or a change in the moving direction of the kite operator, and thus looses its flexibility to adjust power.

Another attempt to solve the problem is by using a stopper ball (21) resting on a fixed member on the center rope. The stopper ball prevents the handlebar from sliding through the center rope, unless the force applied to the handlebar is beyond a certain amount. In order to depower, the handlebar has to be pushed forward vigorously which will push the stopper ball through. The disadvantages are: (a) only limited power adjustment is possible while the handlebar is resting on the stopper ball, (b) the stopper ball has to be reloaded manually, and (c) sometimes the stopper ball slides through unintendedly, and vice versa.

U.S. Pat. No. 6,514,115 'Line system for steering a kite' teaches a different configuration of flying lines, using deflecting pulleys which link flying lines together. As a further ramification, it shows a pulley on the harness side of the control system, which has the purpose to take away the pulling force on the control handlebar. This solution unfortunately does not work on kite control systems which don't use the special line system described in said patent. If the full force of the supporting lines of the kite was redirected to the control handle bar, the kite would uncontrollably power up in a wind gust, and make the operation of the kite very unsafe.

SUMMARY

The invention provides a kite control system which balances the main lifting force of the kite and the force on the control handles under changing wind conditions. It comprises a proportional mechanical redirection device, which redirects the main lifting force of the kite to the control handles, and thus significantly reduces the force thereon and assists with holding and pulling said control handles. The proportional mechanical redirection device can be, in accordance with the embodiments shown here, but are not limited to: (a) a compound pulley system which redirects the main lifting force of the kite to the center of the control handlebar, or (b) control handles configured as levers with a pivot in between the two ends of the lever, proportionally redirecting the movements of the supporting flying lines on the first end to the control lines on the second end.

DRAWINGS—FIGURES

Figure 5A:
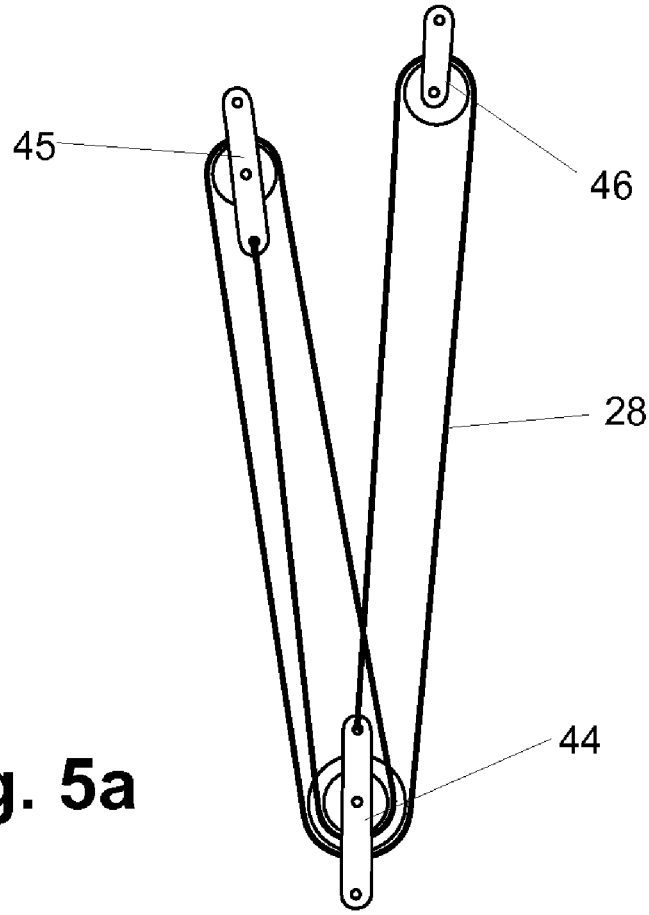

FIG. 5*a* shows a compound pulley system used as a proportional redirection device.

Figure 5B:
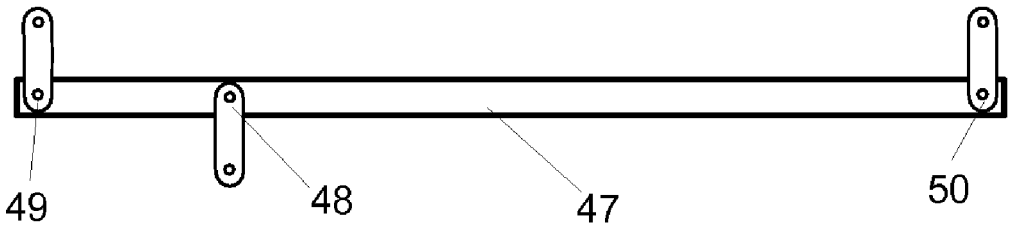

FIG. 5*b* shows a lever used as a proportional redirection device.

DRAWINGS—REFERENCE NUMERALS

1 kite
2 leading edge of kite, (the front of the kite, facing the relative wind direction)
3 left supporting flying line
4 right supporting flying line
5 left control line
6 right control line
7 central connector
8 center rope
9 pulley with V-cleat
10 trim end of the center rope
11 control handlebar
12*a* left hand pulley block for 2:1 steering advantage
12*b* right hand pulley block for 2:1 steering advantage
13 optional harness loop
14 kite operator
15 harness
16 harness bracket
20 swivel
21 optional stopper ball
22 quick release shackle
23 hook
24 triple pulley block with cleat
25 double pulley block
26 snap shackle
27 stopper ring
28 rope of compound pulley system
29 rope guides
30 fine trim rope end
31 connector for a safety leash
32 center handle
33 pivot
34 left control lever
35 right control lever
36 lever connecting rope
37 center pulley block
38 turnable section of lever
39 handle grip
40 threaded portion of lever
41 first swivel point of turnable handle
42 second swivel point turnable handle
43 cylinder with internally treaded bore
44 fixed portion of a redirecting compound pulley system
45 first moving portion of a redirecting compound pulley system
46 second moving portion of a redirecting compound pulley system
47 redirecting lever
48 fixed portion of a redirecting lever
49 first moving portion of a redirecting lever
50 second moving portion of a redirecting lever

DETAILED DESCRIPTION—FIRST EMBODIMENT—FIG. 2

Figure 1:
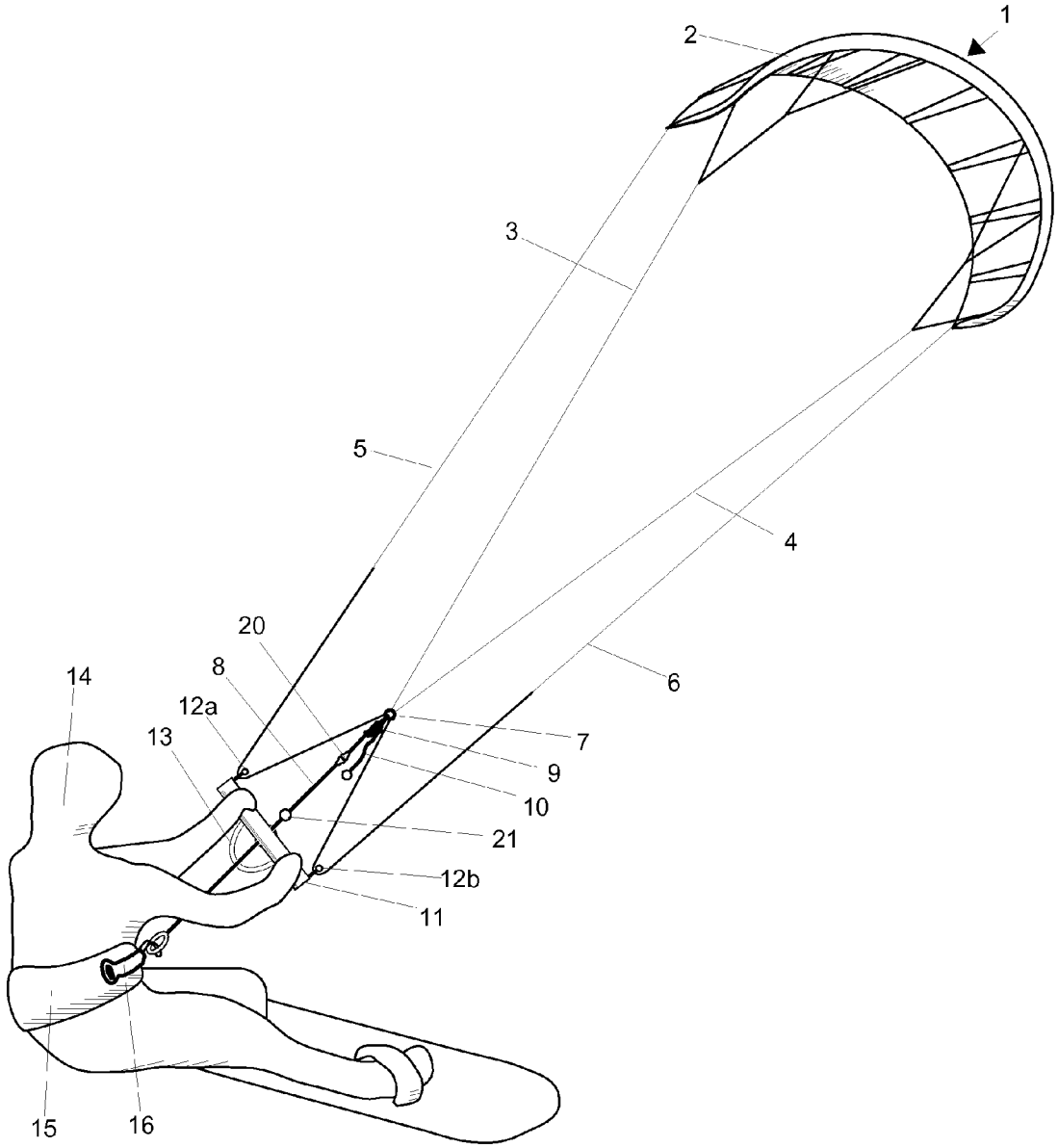
Fig. 1 (Prior Art)
FIG. 1 shows a prior art kite system comprising a kite with multiple flying lines, a kite control system, and a human kite operator who is hooked to the control system and is holding the handlebar controlling the kite.
Figure 2:
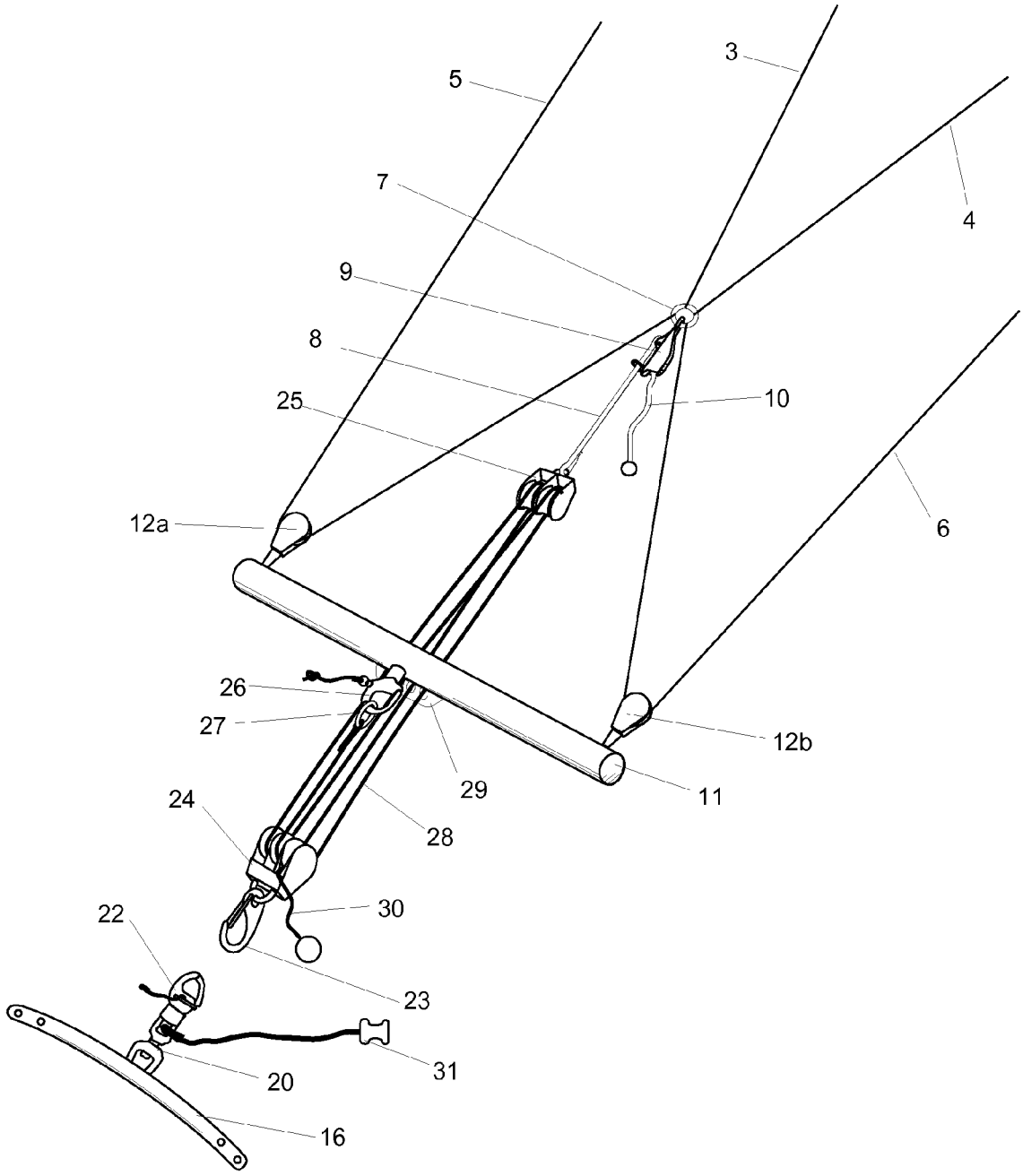
FIG. 2 shows a kite control system in accordance with one embodiment, using a compound pulley system as a proportional redirection mechanism.

FIG. 2 shows a kite control system with a proportional redirection mechanism in accordance with one embodiment. A compound pulley system is used to proportionally redirect the lifting force of the kite to the control handlebar.

Different ratios of redirection are possible with different configurations of the compound pulley system. FIG. 5*a* shows a general view of a redirecting compound pulley system, using pulleys and a rope (28). The system comprises a fixed portion (44), a first moving portion (45), and a second moving portion (46), whereas the mechanical force is redirected from one moving portion to the other. The fixed portion must comprise at least one pulley, in order to redirect the rope of the compound pulley system to the opposite direction. Each of the moving portions comprises either zero or a number of pulleys. The ratio of redirection is determined by the number of pulleys at each moving portion as well as by where the two ends of the rope are attached. One way to determine the ratio of redirection is to count the number of running parts of the rope leading to each moving portion. In the example in FIG. 5*a* the force occurring at the first moving portion is balancing a force on the second moving portion with a ratio of 3:2.

The system in FIG. 2 uses a compound pulley system which is configured for a mechanical advantage of 4, whereas the lifting force of the kite is divided by 4 and redirected to the control handlebar. The three portions of the compound pulley system are:

(a) The fixed portion is operatively connected to the kite operator's harness and comprises a triple pulley block (24) with a cleat. The first end of the rope (28) of the compound pulley system goes through the cleat on the triple pulley block and can be used as a fine trim end (30) of the system. A hook (23) is attached to the triple pulley block and can be connected to a quick release shackle (22) on the harness side. This quick release shackle must be operable under load, and it is connected via a swivel (20) to the harness bracket (16). The harness bracket is fixed on the kite operator's harness. If a safety leash is used, a leash connector (31) must be attached to a point located between the swivel and the quick release shackle, so the safety leash will rotate together with the kite control system and the kite. The other end of the safety leash is usually connected to one of the supporting lines (safety leash not shown).

(b) The first moving portion is operatively linked to the main lifting force of the kite, and comprises a double pulley block (25). A center rope (8) connects the double pulley block to a central connector (7), where the supporting flying lines (3) and (4) are attached. The length of the center rope can be adjusted with one end of the center rope (10) going trough a pulley and V-cleat combination (9).

(c) The second moving portion comprises a stopper ring (27) at the second end of the rope of the compound pulley system. The stopper ring connects to a snap shackle (26) which is attached to the center of the control handlebar (11). The stopper ring must be large enough to be stopped by the triple pulley block when the snap shackle is opened and the rope of the compound pulley system is retracted.

A left hand pulley (12*a*) linked to the left control line (5) is connected to the left end of the handlebar, and a right hand pulley (12*b*) linked to the right control line (6) is connected to the right end of the handlebar. The ends of the control lines lead to the central connector.

An array of rope guides (29) for the rope of the compound pulley system is located centrally between the two ends at the bottom of the handlebar.

Operation—First Embodiment—FIG. 2

The redirection system as described above redirects the force of the main supporting flying lines to the control handle. To depower the kite, the bar simply needs to be pushed forward—no unhooking or other actions are necessary. The compound pulley system as used in this embodiment has a 4:1 mechanical advantage. In this application, the compound pulley system divides the magnitude of the force which is present at the center rope by 4. The reduced and redirected force is effective on the handlebar, and it significantly diminishes the force necessary to keep the kite powered.

To determine the suitable ratio of the proportional redirecting system, the following things need to be considered: When the control handle is not held, the kite should be in a partially powered state. To fully power the kite, the control handle needs to be pulled slightly. To fully depower the kite, the control handle needs to be pushed away slightly. The redirection system can be compared to a power assisted steering in a car which doesn't do all the work but leaves some steering feel to the driver for better and safer driving properties, and which will straighten the wheels automatically if the steering wheel is not held.

For different kites or different applications, there may be a different mechanical advantage of the redirection system necessary, depending on kite design, kite size, number and location of flying line attachment points on the kite, existence of a 2:1 advantage steering system, and personal preference. For common traction kites on the market, a ratio of 1:4 may be suitable to achieve the goals described above.

There are 2 trimming features according to this embodiment. Both features are used to adjust the distance between the kite operator and part of the kite control system in order to keep the control handle at a convenient position in changing wind conditions. At light wind conditions the distance can be increased to allow the full range of movement of the control handlebar. In stronger winds the distance can be shortened to make it easier to push the control handle forward when depowering the kite. The two trimming options are:

(a) The trim end of the center rope can be used to make rough adjustments. Because it is far away from the kite operator it can't be used easily while "on the go". Also to operate this trim easily, the kite should be partially depowered in order to decrease the load on the center rope.

(b) The fine trim end of the compound pulley system's rope can be operated "on the go", as it is in a convenient location, and, because of the 4:1 advantage of the compound pulley system, it can easily and quickly be operated under load. The end of this rope should be attached with an elastic stretch cord (not shown) to the central connector, to keep it out of the way and prevent it from entanglement.

There are 2 safety features in this embodiment:

(a) The snap shackle on the control handle can be opened. The control handle is then freely movable and the kite control system will work like a prior art control system. This safety feature is needed to temporarily minimize the power of the kite in order to correct a problem, for instance an entanglement of lines. This feature is also useful when the wind speed increases dramatically and the kite size is becoming too large for the present wind condition, so a kite surfer could reach the shore with minimal power of the kite.

(b) The quick release shackle on the harness side can be opened in all other cases of emergencies. By opening this shackle the whole kite system is separated from the kite operator and the kite will depower. A safety leash can be used to prevent the loss of the kite.

Tests show very satisfactory results: (a) Arms and Hands don't become tired, (b) when the bar is released: the kite will still hover in the air, it doesn't fall or power up uncontrollably, (c) in strong gusts, no extra effort is necessary to hold the handlebar (d) the handlebar can be held one handed without losing control over the kite. This is necessary when the other hand is busy with something else, i.e. holding the board while trying to start, (e) the fine trim can be adjusted with minimal effort because of the the compound pulley system, and it can therefore be done in an instant, (f) the overall travel distance of the control handlebar from a depowered state to a maximum powered state is shorter than on conventional systems, and therefore the range of power adjustment is increased with the same arm movement distance.

Figure 3:
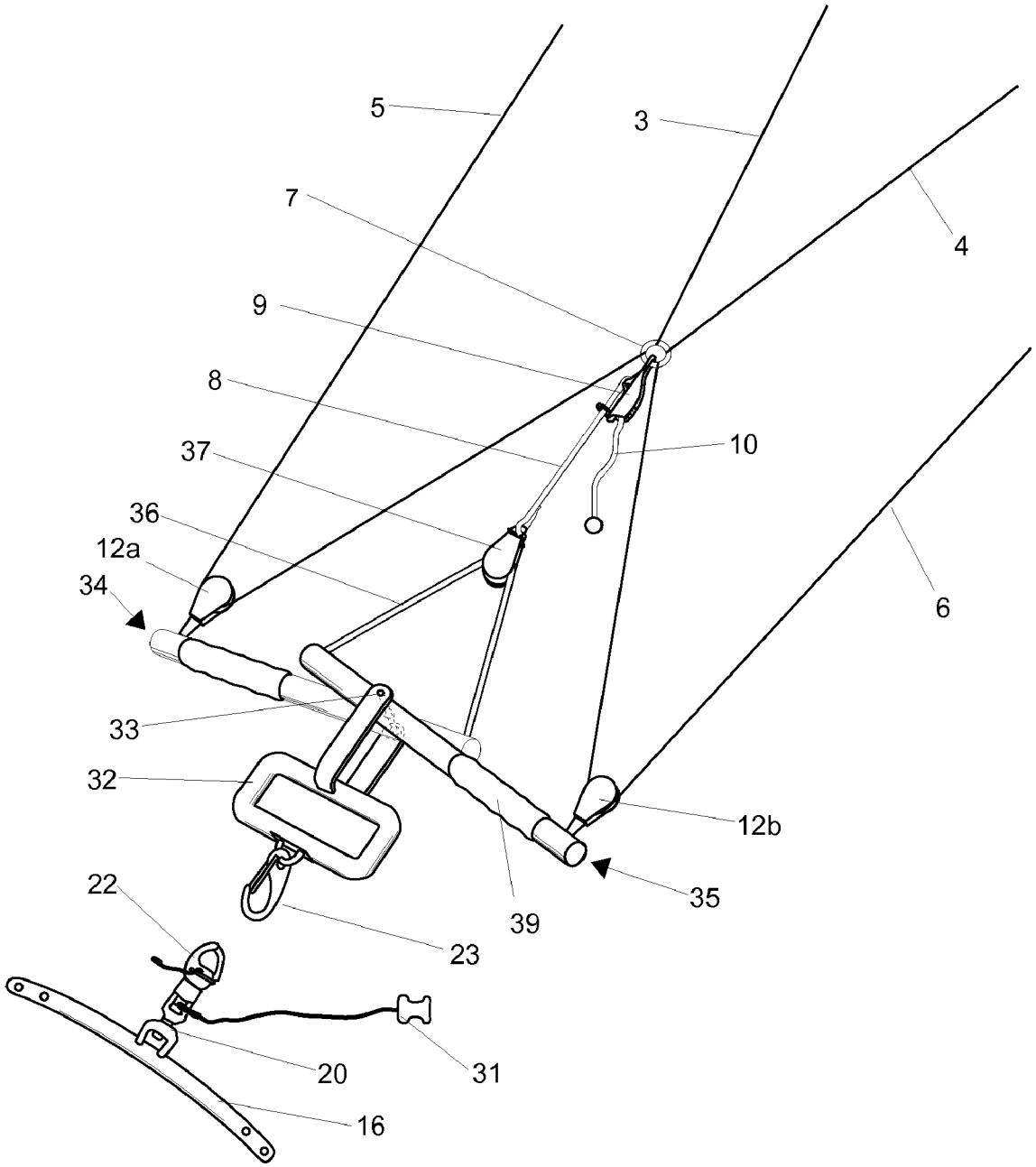
FIG. 3 shows a kite control system in accordance with an alternative embodiment, using levers as a proportional redirection device, with the levers having integrated control handles.
Figure 4:
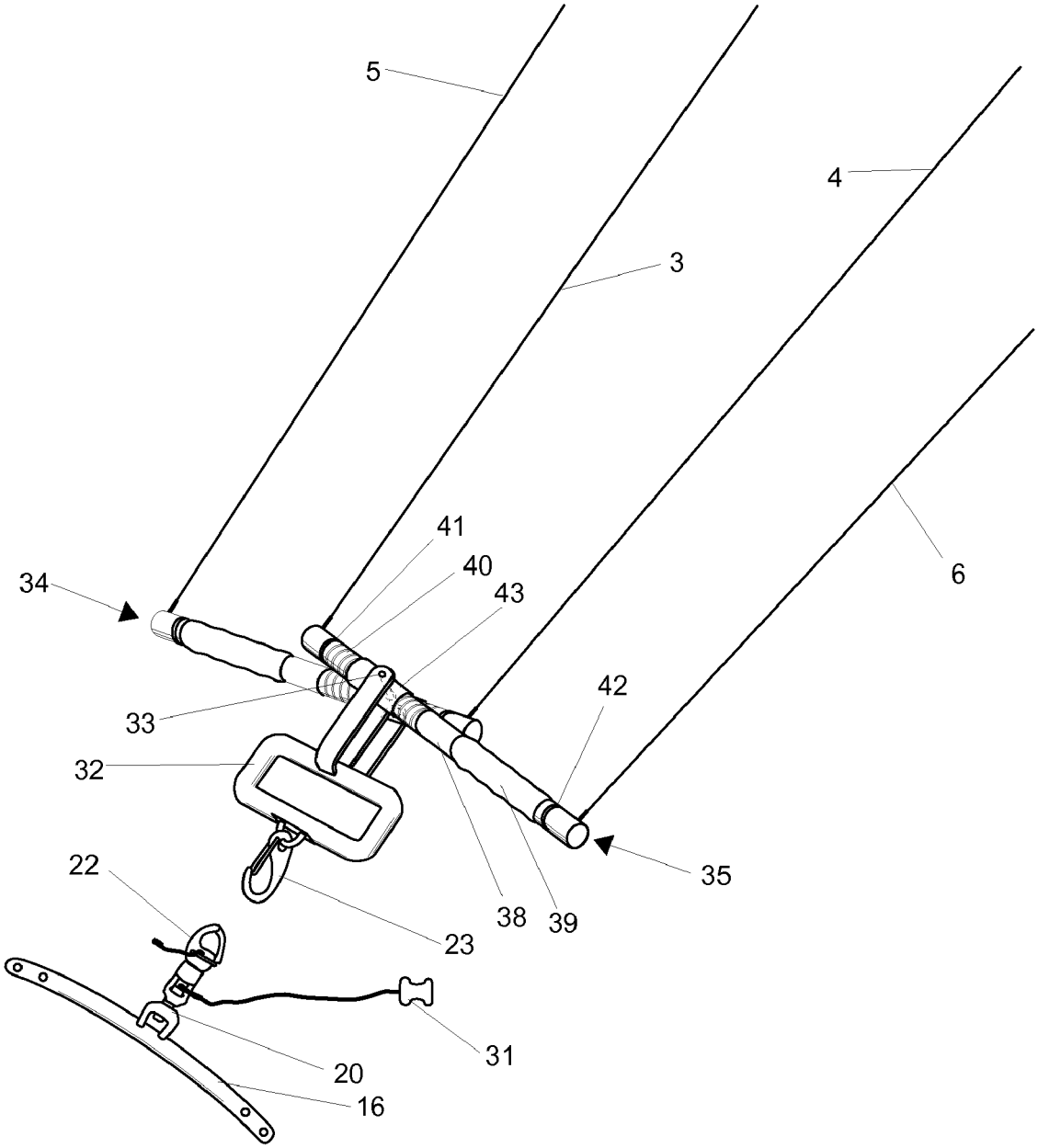
FIG. 4 shows a kite control system in accordance with an alternative embodiment, using levers as a proportional redirection device, having the flying lines directly attached to the levers, and comprising turnable control handles to adjust the ratio of redirection.

Alternative Embodiments—FIGS. 3 and 4

FIG. 3 and FIG. 4 show a kite control systems comprising levers as means of proportional mechanical redirection The advantages of using a proportional mechanical redirection system to redirect the main lifting force of the kite to the control handles are illustrated above in the section of the first embodiment.

FIG. 5*b* shows a basic configuration of a force redirecting lever (47) as used in the context of these embodiments, having a fixed portion (48) at the lever's pivot, a first moving portion (49) at one end of the lever, and a second moving portion (50) at the other end of the lever, wherein the pivot is located in between the two moving portions, and whereas the mechanical force is redirected from one moving portion to the other. The ratio of the distance from the pivot to the first portion and the distance from the pivot to the second portion is inversely proportional to the ratio of the redirected force from one end to the other.

In FIG. 3 and FIG. 4, a left control lever (34) and a right control lever (35) are used, whereas the fixed portion of each lever is operatively connected to the harness, the first moving portion is connected or indirectly linked to a set of main supporting flying lines, and the second moving portion is linked to a control line. The two levers have their pivot (33) rotatably fixed between brackets on a center handle (32). Connected to the center handle is a hook (23) for securing the control system to the harness.

In FIG. 3, the first moving portion of the left lever is connected by a connecting rope (36) to the first moving portion of the right lever. Said connecting rope loops around a center pulley block (37) which is fixed to the center rope (8). The second moving portion of each control lever integrates a handle grip, and attached to the left hand handle is a pulley (12*a*) linked to the left control line (5) and attached to the right hand handle is a pulley (12*b*) linked to the right control line (6).

FIG. 4 shows a configuration without central connector, but which has direct connections from the levers to the flying lines. The first moving portion of the left lever (34) is connected directly to the right supporting flying line (4), and the first moving portion of the right lever (35) is connected directly to the left supporting flying line (3).

An additional ramification is shown if FIG. 4. Each control lever (34) and (35) comprises a turnable section (38) between two swivel points (41) and (42), having an integrated handle grip (39), and having a male threaded part (40). This thread goes through its female counterpart in the bore of a cylinder (43). The split axle on the pivot of the lever is mounted on either side of this cylinder, in order not to conflict with the threaded parts. Thus, by twisting the handle, the location of the pivot on the lever is easily moved along the lever in order to adjust the ratio of force redirection.

CONCLUSION, RAMIFICATIONS, AND SCOPE

Accordingly the reader will see that the kite control systems of the various embodiments have many advantages, and allow for the operation of the kite in a more convenient, flexible, versatile and safe manner, as the control handles can be released or pushed away without any additional action necessary, while still providing a substantial relief of the force on the control handle and avoiding exhaustion in arms and hands. Furthermore, greater steering control of the kite is possible, no loss of control is experienced when only one hand is holding the bar, and additionally, the control system can easily be trimmed.

While the above description contains many specificities, these should not be construed as limiting the scope of any embodiment, but as exemplifications of the presently preferred embodiments thereof. Many other ramifications and variations are possible within the teachings of the various embodiments, for example by using alternative redirection mechanisms, using different ratios of redirection, combining redirection systems of different types, etc.

Thus the scope of the invention should be determined by the appended claims and their legal equivalents, and not by the examples given.

I claim:

1. A device for controlling a kite having a plurality of flying lines and control lines comprising:

A left hand lever and a right hand lever, each lever used as a proportional mechanical redirection means and having a first end, a second end, and a pivot located between said first end and said second end, whereas the proportional redirection of motion and mechanical force occurs between said first end and said second end, (a) wherein each said pivot is operatively connected to a kite operator's harness, (b) wherein each of said first end is operatively connected to a subset of said kite's flying lines with no steering functionality and which bear a substantial part of the lift force of said kite, (c) wherein each said second end is linked to a control handle and is linked to at least one of said kite's control line with steering functionality, whereby said lift force of the kite is redirected to each of said lever's second end, thus assisting with controlling the kite, reducing the effort needed to hold or move said control handles, avoiding exhaustion of the kite operator and improving controllability of said kite.

2. The device of claim 1, each lever further comprising a mechanical means for moving the location of said pivot along the longitudinal axis of said lever, and thereby changing the ratio of the proportional mechanical redirection of said lever.

3. The device of claim 2, wherein said mechanical means for moving the pivot comprises a male threaded part and a female threaded part, whereby the location of said pivot can be moved along the longitudinal axis of said lever by a twisting motion of said handle.

* * * * *